United States Patent [19]

Gallant et al.

[11] 4,189,887

[45] Feb. 26, 1980

[54] COPING WITH INLAID TILE

[76] Inventors: James J. Gallant, 4655 Briercrest Ave., Lakewood, Calif. 90713; Clarence T. Childress, Whittier, Calif. 90606

[21] Appl. No.: 905,758

[22] Filed: May 15, 1978

[51] Int. Cl.[2] ..... E04C 2/30

[52] U.S. Cl. ..... 52/311; 52/169.7; 4/172.21; D25/2

[58] Field of Search ..... 52/169.7, 300, 311, 52/314.35, 316; 4/172.19, 172.21, 146; D25/2

[56] References Cited

U.S. PATENT DOCUMENTS 2,729,093 1/1956 Ridley ..... 52/169.7

OTHER PUBLICATIONS

Design Patent I95,025 to Jefferson et al., dated Apr. 16, 1963.

Design Patent 201,875 to Robb dated Aug. 10, 1965.

*Primary Examiner*—James L. Ridgill, Jr.

*Attorney, Agent, or Firm*—Ronald L. Juniper

[57] ABSTRACT

Coping specially formed to provide inset areas for matingly shaped inlaid decorative tile adapted for use around swimming pools. The method for molding such coping and inserting tile therein.

5 Claims, 6 Drawing Figures

FIG. 1
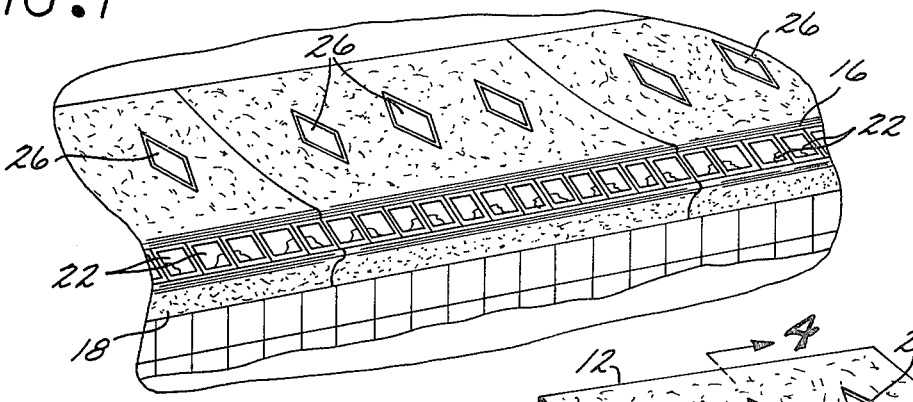
FIG. 2
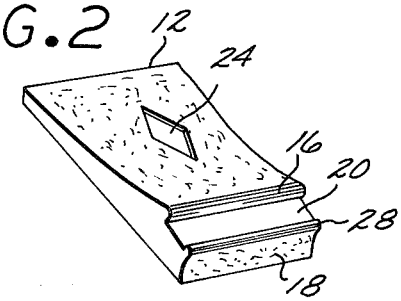
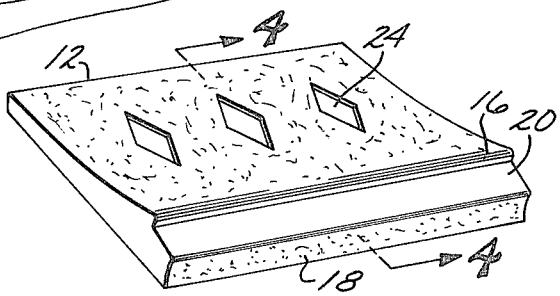
FIG. 3
FIG. 4
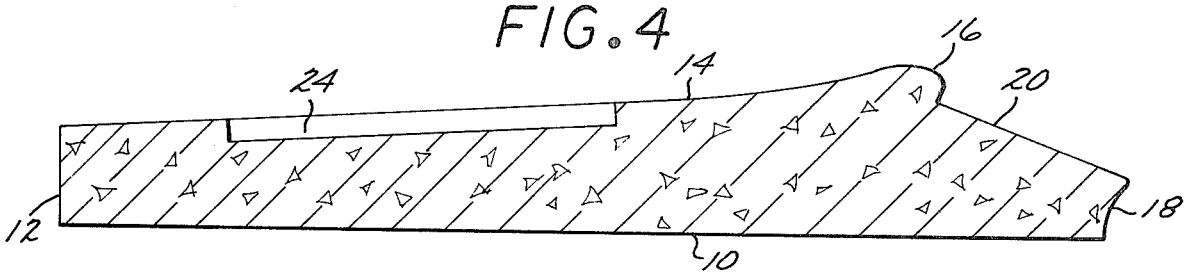
FIG. 5
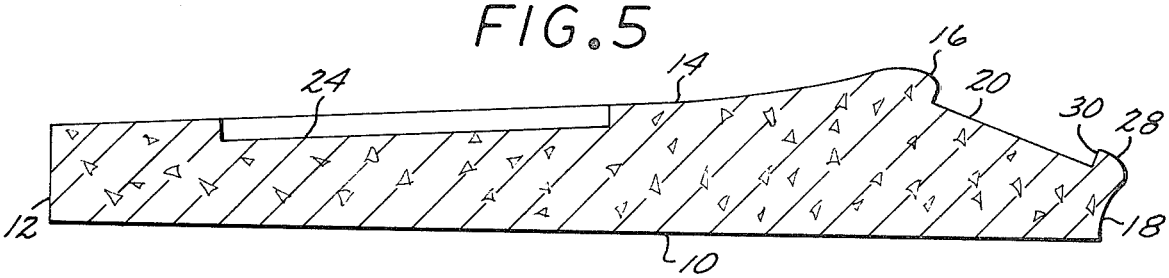
FIG. 6
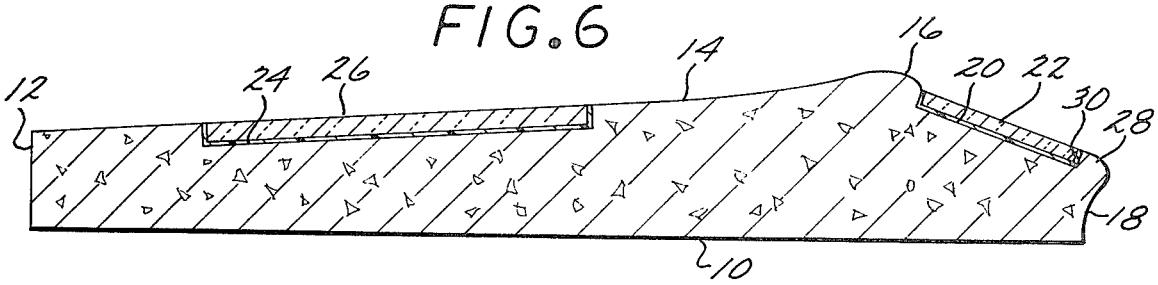

COPING WITH INLAID TILE

BACKGROUND OF THE INVENTION

Prior to this invention there was a need to provide a practical means and structure for decorative tile inlaid in coping surrounding swimming pools. However, existing coping and procedures for installation were either too expensive or produced undesirable results.

Accordingly, the special shape and molding of the coping and insertion of tile therein overcoming these prior problems is a primary object of this invention.

SUMMARY OF THE INVENTION

The coping in this invention is specially molded to provide for predeterminedly positioned inlay of tile. It is shaped and sized to fit around the periphery of swimming pools so as to provide a decorative appearance. The tile receiving recesses are sized to receive the tile pieces securely and flush with the top surface of the coping.

An inclined, forwardly sloping, tile recess area on the inside periphery of the coping is angled enough to allow water to flow off easily, but not sloping so steeply that this adjacent edge surface becomes too slippery.

DETAILED DESCRIPTION OF THE DRAWINGS

FIG. 1 is a fragmented perspective view of the top wall edge of a swimming pool showing pieces of mated coping in place with decorative tile inserted along the edges and spaced on the top surface of the coping sections.

FIG. 2 is a sectional perspective view of a separate portion of a coping showing an example of inserted tile.

FIG. 3 is a perspective view of a coping section in accordance with this invention showing pockets molded into the coping which are sized and shaped to receive mating tile flush with the top surface of the coping.

FIG. 4 is a cross-sectional view taken through 4—4 in FIG. 3 showing the depth of the pockets in the coping adapted to conform with the tile to be mounted therein.

FIG. 5 is a cross-sectional view like FIG. 4 showing a modified form having a raised tile-holding lip on its outer edge.

FIG. 6 is a cross-sectional view of the coping with tile mounted therein.

DETAILED DESCRIPTION OF PREFERRED EMBODIMENTS OF THE INVENTION

Coping elements in accordance with this invention are comprised of sections (such as shown in FIG. 3) which are combined to provide a peripheral top surface around the edges of a swimming pool, as partly shown in FIG. 1.

It is desired that decorative tile be mounted in coping, an example of which is shown in FIG. 6. To do so without substantial expense and difficulty is a primary purpose of this invention.

Each of the coping sections is specifically shaped to provide a mating portion of the top edge surface for a swimming pool in the preferred application of the invention as herein described.

Thus, referring to the cross-sectional view shown in FIG. 4 a coping section is formed with a flat bottom 10 and, perpendicular thereto, a rear wall 12 of a relatively shallow depth which matches the edge recess depth surrounding the swimming pool around which it is to be mounted.

The top surface 14, of the coping section, rises gradually upwardly from the rear wall 12 to a rounded, laterally running ridge 16 which extends substantially parallel with said rear wall 12, but is nearer to a concavely curved front wall 18 which rises upwardly from the forward edge of bottom 10.

Slanting upwardly from the top edge of front wall 18 to connect with the front of rounded ridge 16 is a flat-surfaced, tile-holding slope 20 which is a forward surface sloping downwardly opposite from top surface 14.

The angle of this slope 20 relative to bottom 10, which is substantially level when in use, is predetermined so as to be steep enough to facilitate drainage of water splashed thereon, but shallow enough to prevent slippage tendencies of the tile secured thereon. It has been found that an angle of about thirty degrees, such as bottom 10, is preferred.

The depth of the slope 20 relative to the forward portion of ridge 16 is substantially equal to the thickness of tile to be secured thereon. Thus, because of this substantially equal depth and height measurements, ridge 16 with a tile inlaid on slope 20 provides a substantially even surface forward from the top of ridge 16 over slope 20.

The top surface 14 may be provided with recessed areas 24 which are shaped to matingly receive a decorative tile 26 therein flush with the top surface 14 as shown in FIG. 6.

In order to provide more secure footing for tile on slope 20 a further modification of the form is shown in FIG. 5. This form is provided with a raised lip 28 which extends upwardly from front wall 18 to the thickness of a tile relative to slope 20 and terminates at its rear edge to form the bottom recess wall 30 rising from slope 20.

The coping sections are made from a master mold to the shape desired with the tile retaining recesses and sloping areas predetermined. Then the coping is molded to the shape of the master mold. After setting to solid form cement is used to secure the tiles which are matingly inlaid into predetermined recessed areas of the coping sections.

Although preferred embodiments of this invention have been described herein these are not meant as limitation thereof but illustrations of forms. The scope of this invention is intended to comprehend all examples within the spirit of the claims.

What is claimed is:

1. A coping specially formed with an upwardly rising top surface and an adjacent forward surface sloping downwardly opposite from said top surface and a ridge defining the juncture between said top and forward surfaces, and inset areas in said top and forward surfaces for mating inlaid tile.

2. A coping as defined in claim 1 formed with a flat bottom, a shallow rear wall, said top surface rising gradually from said rear wall to said ridge, said forward sloping surface recessed down from said ridge the depth of a tile to be mounted thereon, and angled more steeply from said ridge than said top surface and terminating in a forward wall lower in height than said rear wall.

3. A coping specially formed with an upwardly rising top surface and an adjacent forward surface sloping downwardly opposite from said top surface and a ridge defining the juncture between said top and forward surfaces, inset areas in said top and for surfaces for mating inlaid tile, and tile mating with and secured in said inset areas.

4. A coping as defined in claim 1 which is provided with a forward lip immediately defining the forward wall of said sloping upper surfaces.

5. A coping as defined in claim 4 formed with said forward lip rising from said forward wall, which is concavely curved the thickness of a tile to be inlaid therein relative to said sloping forward section.

* * * * *